US008322983B2

(12) United States Patent
Marini

(10) Patent No.: US 8,322,983 B2
(45) Date of Patent: Dec. 4, 2012

(54) CERAMIC MATRIX COMPOSITE STRUCTURE

(75) Inventor: Bonnie D. Marini, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 1119 days.

(21) Appl. No.: 12/208,542

(22) Filed: Sep. 11, 2008

(65) Prior Publication Data

US 2010/0062210 A1 Mar. 11, 2010

(51) Int. Cl.
*F01D 25/24* (2006.01)

(52) U.S. Cl. ..... 415/214.1; 415/134; 415/213.1

(58) Field of Classification Search ..... 415/134, 415/213.1, 214.1
See application file for complete search history.

(56) References Cited

U.S. PATENT DOCUMENTS

| | | | | |
|---|---|---|---|---|
| 2,695,182 | A * | 11/1954 | Folz | 285/123.1 |
| 5,415,443 | A * | 5/1995 | Hayashi | 285/405 |
| 5,468,025 | A * | 11/1995 | Adinolfe et al. | 285/114 |
| 5,941,653 | A * | 8/1999 | Cipriani | 403/344 |
| 6,617,013 | B2 | 9/2003 | Morrison et al. | |
| 6,648,597 | B1 | 11/2003 | Widrig et al. | |
| 6,670,021 | B2 | 12/2003 | Schroder et al. | |
| 6,670,046 | B1 | 12/2003 | Xia | |
| 6,708,495 | B2 | 3/2004 | Calvez et al. | |
| 6,709,230 | B2 | 3/2004 | Morrison et al. | |
| 6,746,755 | B2 | 6/2004 | Morrison et al. | |
| 6,773,215 | B2 | 8/2004 | Cuva et al. | |
| 6,830,437 | B2 | 12/2004 | Cairo et al. | |
| 6,904,757 | B2 | 6/2005 | Mitchell et al. | |
| 7,044,709 | B2 | 5/2006 | Bruce et al. | |
| 7,066,717 | B2 | 6/2006 | Morrison et al. | |
| 7,093,359 | B2 | 8/2006 | Morrison et al. | |
| 7,153,054 | B2 | 12/2006 | Arbona | |
| 7,153,096 | B2 | 12/2006 | Thompson et al. | |
| 7,247,002 | B2 | 7/2007 | Albrecht et al. | |
| 7,247,003 | B2 | 7/2007 | Burke et al. | |
| 7,249,462 | B2 | 7/2007 | Aumont et al. | |
| 2007/0048144 | A1 * | 3/2007 | Morrison et al. | 416/224 |
| 2007/0122266 | A1 * | 5/2007 | Cairo et al. | 415/134 |
| 2009/0226279 | A1 * | 9/2009 | Jarmon | 411/340 |

* cited by examiner

*Primary Examiner* — Olik Chaudhuri
*Assistant Examiner* — Nicholas Tobergte

(57) ABSTRACT

A composite structure (10), which may be a 2-dimensional ceramic matrix composite material, may include a first body (30) made of a composite material defining a first in-plane direction, a second body (20) made of a composite material defining a second in-plane direction wherein the first body (30) is connected with the second body (20) so that the first in-plane direction is substantially normal to the second in-plane direction. The second body (20) of the composite structure may include a first leg (24), a first bolting surface (22) extending from the first leg (24) and at least one aperture (56) formed in the first bolting surface (22) substantially normal to the second in-plane direction. A first recess (32) may be formed within the first body (30) sized to receive the first leg (24).

13 Claims, 1 Drawing Sheet

CERAMIC MATRIX COMPOSITE STRUCTURE

FIELD OF THE INVENTION

This invention relates to composite structures in general, and more specifically, to high temperature ceramic matrix composite ("CMC") components that incorporate a flange for connecting the component with another object.

SUMMARY OF THE INVENTION

Embodiments of the present invention provide a mounting or bolting flange integral with a CMC component for carrying a load that may be perpendicular to the fiber surface of the component. This bolt flange may be fabricated of a composite material and in an exemplary embodiment may be a 2-dimensional composite material that may have the same or similar properties as the CMC component materials. This avoids issues associated with dissimilar materials, such as thermal mismatch, which may be a problem if a metal bolt flange was used. Embodiments allow for the bolt flange to be connected with a CMC component. Holes may be fabricated in a bolting surface of the bolt flange that are substantially normal to a fiber direction of the bolting surface thereby allowing the fiber to provide the strength for bearing loads.

The mounting or bolting flange may include one or more support structures or legs affixed thereto that extend beneath and are perpendicular to the fiber direction within or below the composite surface of the CMC component. The composite material of the CMC component or filament may be laid over the support structures to prevent them from pulling through the CMC component surface. A slot in the main composite part allows a bolting surface of the bolt flange to protrude above the composite surface of the CMC component, providing a bolting surface or plate substantially perpendicular to the main composite part.

DETAILED DESCRIPTION OF THE INVENTION

Ceramic matrix composites may be used for fabricating components or other structures of a combustion turbine engine and may typically include a ceramic matrix reinforced with ceramic fibers. In a typical CMC component construction, fabric layers may be wrapped over each other so that the fibers are primarily aligned substantially parallel to the surface of a component or mandrel. For example, for a 0/90 degree fabric lay-up the fibers in a turbine vane would be oriented substantially parallel to the gas path around the vane and along the vane radially to the turbine.

Continuous fiber-reinforced CMC materials are typically woven from tows (bundles of individual filaments) using conventional textile weave patterns, in which two or more sets of tows are woven, with the individual tows of each set passing over and under transverse tows of the other set or sets. Alternately, fibers may be laid parallel to each other and the next layer of fibers may be laid on top without weaving the fibers. Components made of such CMC materials typically exhibit relatively poor interlaminar tensile and shear strengths, which may create problems if the component needs to be connected with another structure.

Figure 1:
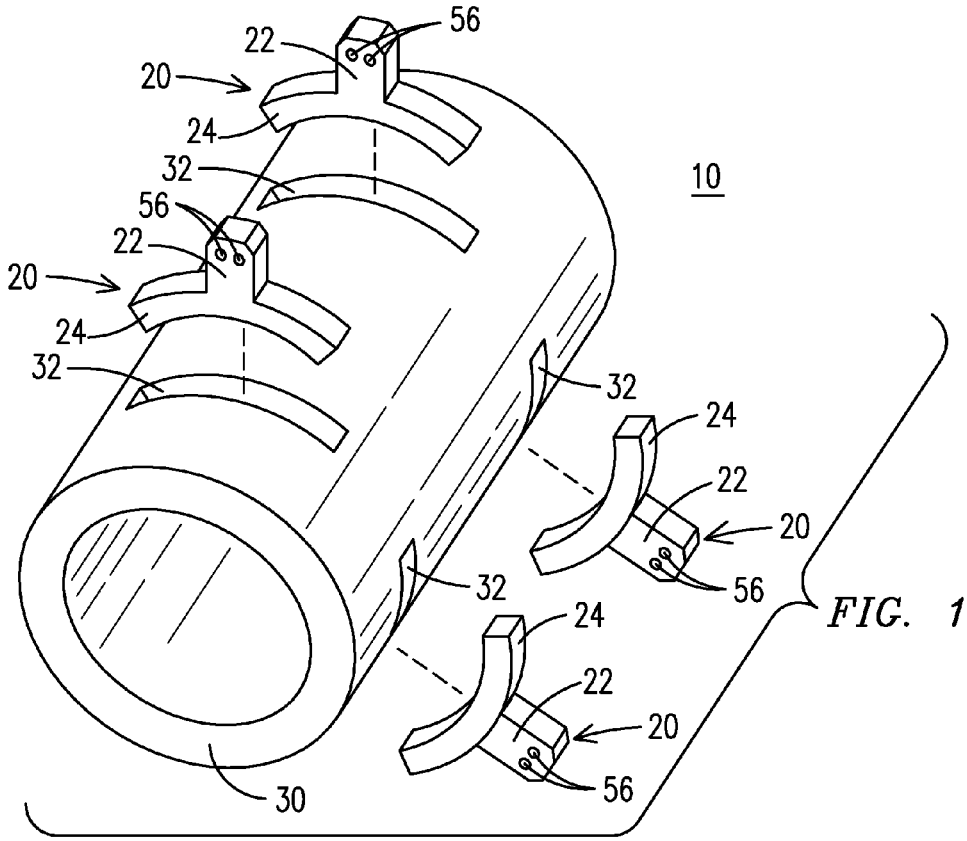
FIG. 1 illustrates an exploded view of an exemplary plurality of bolting flanges and a first body or mandrel.

The particular type of CMC material used to form a component, such as CMC component 10 in FIG. 1, is not critical to the invention. Generally, CMC materials of the type used in gas turbine engine applications will have a laminate construction, in which multiple layers of continuous fiber-reinforced CMC material are used to build up a CMC component 10. Suitable continuous fiber-reinforced CMC materials include silicon carbide, silicon nitride or silicon fibers in a silicon carbide, silicon nitride and/or silicon-containing matrix material. Each layer generally contains sets of fiber bundles or tows (not shown) woven in a suitable weave pattern.

A 2-dimensional CMC component or structure is typically weaker in the plane perpendicular to the fiber direction. In some cases, the interlaminar tensile strength in this plane is very low. CMC components for use in high temperature gas turbine environments need to account for interlaminar tensile strength due to the various forces exerted on the components during turbine operation. For example, the inherent weakness of interlaminar tensile strength in a CMC component makes the design of attachments to the component challenging.

One approach is to design attachments such that a load path created by virtue of the attachment is in the plane of the fibers. For example, bolting could be done through the thickness of the weave. In this case, the load on the bolt is carried by the fibers, not by the matrix, which could result in tear through if the load creates too much force. Another design approach is where the bolthole is parallel to the fibers, in which case the matrix alone is carrying the load. However, attachments where the hole can be perpendicular to the fibers are limited in their applications because they don't provide for carrying a load perpendicular to the fiber surface.

It is often desirable to carry a load cross plane with respect to a CMC component such as for securing the CMC component to another component or supporting structure within a turbine engine. In a metal component, or a component made of other orthotropic material, the component could be bent into an L-shape to accommodate carrying a load cross plane. However, with CMC materials or other composites having low interlaminar tensile strength, bends in the material have very little strength and the load carrying capability of a flange formed by bending is severely hampered.

Embodiments of the present invention allow for eliminating bends within a CMC component or structure to create a mounting surface perpendicular to the fiber direction of the main body of the component or structure. FIG. 1 illustrates a segment of an exemplary CMC component 10 that includes a plurality of exemplary composite bolt flanges 20 prior to integration with a mandrel 30. Bolt flanges 20 may be fabricated in the same manner with the same materials as a typical 2-dimensional CMC component with the fiber direction being perpendicular to holes or apertures 56 formed within bolt flange 20. Bolt flanges 20 may have various shapes and sizes depending on the specific application. Other composite materials may be used for their fabrication as a function of operating environments and performance requirements.

An exemplary embodiment of a bolt flange 20 may include a bolting surface 22 extending perpendicularly from and positioned approximately at the midpoint of a base or leg 24. The exemplary bolting surfaces 22 of FIG. 1 may be substantially rectangular configurations extending from respective legs 24. Bolting surfaces 22 may assume other configurations provided adequate bolting surfaces are established for affixing component 10 to another surface. The positional relationship of a bolting surface 22 to a leg 24 may vary depending on the application and leg 24 may have more than one bolting surface 22 extending there from. For example, first and second spaced apart bolting surfaces 22 may extend from a leg 24 with one bolting surface 22 positioned near a first end of leg 24 and a second bolting surface 22 positioned near the second end of leg 24.

A first body or mandrel 30 may include one or more recesses 32 within which a respective second body or bolt flange 20 may be secured for integrating bolt flange 20 with mandrel 30 to form CMC component 10. Any desired number of recesses 32 may be formed at various locations along the longitudinal axis of mandrel 30 and may be offset laterally from each other depending on the specific application. Four recesses 32 and corresponding bolt flanges 20 are shown in FIG. 1 for illustrative purposes only. Mandrel 30 is illustrated as cylindrical but it will be appreciated that mandrel 30 may assume various shapes and sizes depending on the specific application.

In an embodiment of the invention, mandrel 30 may be made having an internally coated material system, such as a thermal barrier coating ("TBC") material applied on the internal diameter of mandrel 30, which may be a permanent part of the CMC component 10. For example, mandrel 30 may be made of a friable graded insulation (FGI) such as that disclosed in U.S. Pat. Nos. 6,670,046 and 6,235,370, both of which are specifically incorporated herein by reference for the entirely of their disclosures. Embodiments of the invention allow for bolt flanges 20 to be embedded within the FGI. In alternate embodiments mandrel 30 may be removed as recognized by those skilled in the art.

Figure 2:
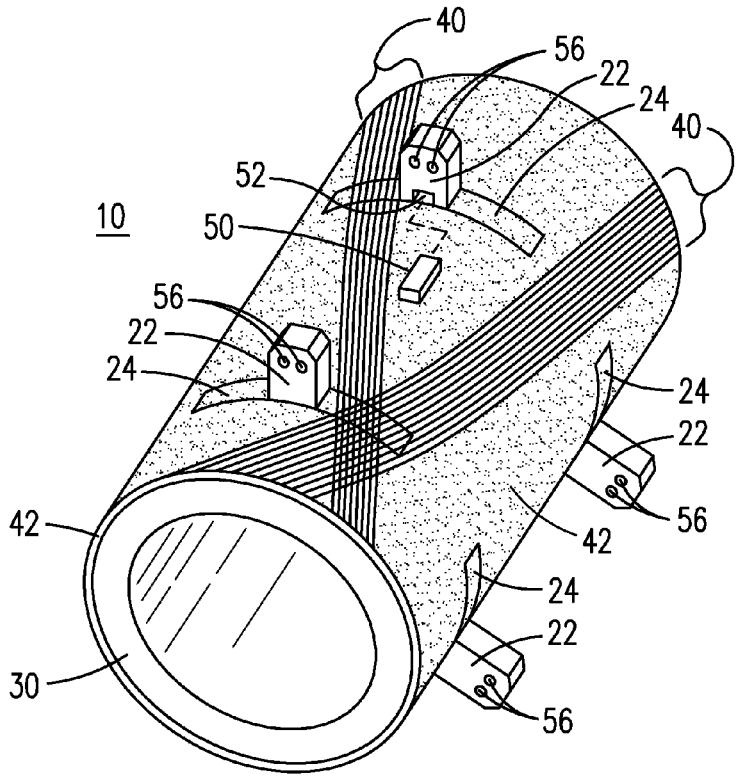
FIG. 2 illustrates the exemplary plurality of bolting flanges and first body or mandrel of FIG. 1 at a stage of manufacture.

Each of the plurality of recesses 32 may be arcuate shaped to match the contour of mandrel 30 and for, receiving the similarly arcuate shaped legs 24 of respective bolt flanges 20. Legs 24 may be recessed within mandrel 30 so that their upper surfaces are substantially flush with the exterior surface of mandrel 30, as shown in FIG. 2. This allows for legs 24 to be positioned within respective recesses 32 and held in place such as by winding filament 40 around mandrel 30 to capture legs 24 within the respective recesses 32. In an embodiment of the invention, a TBC 42 may be deposited over mandrel 30 with filaments or fibers 40 wound over the TBC. In this respect, legs 24 of respective bolt flanges 20 may be captured within recesses 32 formed within mandrel 30 and TBC 42.

Holes or apertures 56 may be either drilled or otherwise fabricated into bolt flange 20 in the direction perpendicular to the fiber direction of bolting surface 22 and leg 24 thereby allowing the fiber to provide strength in a load path direction. Holes 56 may be substantially cylindrical or formed in other suitable shapes such as square or as elongated slots. Holes 56 may be smooth bore or threaded for receiving a bolt or other mechanical fastening means. Embodiments of the invention allow for legs 24 of respective bolt flanges 20 to be situated beneath and perpendicular to the composite surface of the main composite part 10 as shown in FIG. 2. In this aspect, the radial thickness of an installed leg 24 may be less than the radial thickness of the mandrel 30 so that mandrel 30 constrains legs 24 in the radial direction. Bolt flanges 20 and mandrel 30 may be fabricated of the same composite, or similar composite, avoiding issues with dissimilar materials, such as thermal mismatch, which may be a problem if bolt flange 20 were fabricated of metal.

Bolt flanges 20 may be used with a variety of CMC component forming techniques such as being part of a fabric lay-up composite, or as part of a filament wound structure. FIG. 2 illustrates a filament wound example, where bolt flange 20 is inserted into mandrel 30 so it extends from the composite surface, and the composite filament or fiber 40 is wound over legs 24 of respective bolt flanges 20. Bolting surface 22 of bolt flange 20 may extend substantially perpendicularly from the composite surface or it may extend at other desired angles depending on the application. Mandrel 30 may become a permanent part of the CMC component 10 or it may be removed subsequent to fabrication of the component.

If the fabrication of CMC component 10 requires the removal of mandrel 30 then the recesses 32 may be formed through the thickness of mandrel 30. This allows for legs 24 of respective bolt flanges 20 to extend below the surface of the composite part. In this example, bolt flanges 20 may be locked in place with a keying system via key 50 and slot 52 formed in respective bolt flanges 20 as shown in FIG. 2. Bolt flanges 20 may be prevented from falling out of mandrel 30 prior to complete assembly of CMC component 10 by forming a modified shape of the composite around the flange, or having a thickness of composite material over leg 24 to constrain bolt flange 20. Means for securing or affixing bolt flange 20 to CMC component 10 may include recesses 32, legs 24 with filament 40 wound there over and/or key 50 and slot 52.

Bolt flanges 20 may be fabricated by cutting them to shape from a sheet of 2-dimensional CMC material, such as an oxide based ceramic matrix composite manufactured using a woven fabric lay up process. Means for fastening, such as holes or apertures 56 may then be formed within bolting surface 22 for connecting bolt flange 20 with another surface or component. It will be appreciated that the number, size and location of apertures 56 may vary depending on the specific application. Bolt flanges 20 having apertures 56 formed therein may then be connected with mandrel 30 to form CMC component 10 with bolting surface 22 extending perpendicularly to the main body of the CMC component 10. Alternately, the filament wound cylinder or mandrel 30 of FIG. 2 could be fabricated first then bolt flanges 20 may be embedded therein either permanently through a bonding process, or mechanically attached. For example, recesses 32 may be formed within the already would cylinder 30 and legs 24 of respective bolt flanges 20 may be secured within respective recesses such as by secondary bonding them therein using a ceramic cement or other bonding substance.

Bolting surfaces 22 via one or more apertures 56 may be used for connecting respective CMC components 10 to an anchoring surface or another component, such as an adjacent CMC component by using various mechanical or other types of fastening means. Fastening means may include bolts, clamps, pins, etc. suitable for fastening bolting surfaces 22 with another surface or component. For example, CMC components 10 may be formed as hot gas carrying conduits that may be connected together end to end via adjacent bolting surfaces 22 and apertures 56. In this respect, bolt flanges 20 may be located proximate the ends of the conduits so that adjacent bolt flanges 20 may be used for connecting the conduits together via a fastening means.

Bolt flanges 20 may be integrated with mandrel 10 so that the flanges 20 have a range of motion, which allows for flexibility when connecting the flanges 20 to another component or structure. For example, recesses 32 may be fabricated so that they are longer than legs 24 of respective bolt flanges 20. This allows for legs 24 to slide within respective recesses 32 provided that filament 40 is not wound in a manner to restrict such motion. Filament 40 may be wound to capture legs 24 within respective recesses 32 while creating an opening in the weave to allow for motion of the bolt flanges 20 within respective recesses 32.

Bolting surfaces 22 and apertures 56 form a mounting surface perpendicular to mandrel 30 that may be used in various ways to connect CMC components 10 together or to another supporting structure or mounting surface. Various mechanical or other fastening means may be used for making these connections such as by hard mounting respective bolt flanges 20 to each other, to another support structure or mounting surface in fixed relation thereto. An exemplary fastening means may be bolted to a bolting surface 22 on a first CMC component 10 and extend through an aperture 56 on a bolting surface of a second CMC component 10 for a respective fastening means that may not have the same thermal growth as the CMC components 10. For example, a metal will typically expand more when operated at high temperature than a ceramic based material such as CMC component 10, so a sliding interface where the bolt is inserted into a slot instead of a round hole may be appropriate in some areas to prevent overstressing either the component or the bolt.

Other fastening means such as a pin detachment in one side could be used so it can slide on rails where the rail can be either machined into the CMC component 10, and possibly lined with a wear resistant material, or where the rail exists in the mating part and the pin is affixed to the CMC flange.

Embodiments of the invention may be used to hold two or more CMC components 10 or structures together. For example, bolt flanges 20 may be formed in various shapes and sizes such as for use as a T-shape connection between CMC components 10. Bolt flanges 20 may be formed in other shapes and sizes whereby both ends of respective flanges 20 are connected to adjacent mandrels 30 via respective recesses 32 or other connecting means. In this aspect, bolt flanges 20 serve as connecting pieces that are substantially perpendicular to the adjacent CMC components. Such applications may include table or box shapes and others suitable for application specific purposes.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

The invention claimed is:

1. A composite structure comprising:

a first body made of a ceramic matrix composite material comprising fibers defining a first in-plane direction;

a second body made of a ceramic matrix composite material comprising fibers defining a second in-plane direction, the second body comprising: a first leg; a first bolting surface extending from the first leg; and at least one aperture formed in the first bolting surface substantially normal to the second in-plane direction; and the first body connected with the second body so that the first in-plane direction is substantially normal to the second in-plane direction.

2. The composite structure of claim 1 further comprising:

a first recess formed within the first body sized to receive the first leg; and a filament wound over a portion of the first recess to retain the first leg within the first recess.

3. The composite structure of claim 2 further comprising:

a slot formed within the first leg; and a key fitted within the slot and affixed to the first body.

4. The composite structure of claim 1 further comprising the first body and the second body fabricated from a 2-dimensional ceramic matrix composite material and forming a component within a combustion turbine.

5. The composite structure of claim 4 further comprising:

a first recess formed within the first body sized to received a portion of the second body so that the second body may move relative to the first body; and a filament wound over a portion of the first recess to retain the portion of the second body within the first recess.

6. The composite structure of claim 1 further comprising:

the first body fabricated from a 2-dimensional ceramic matrix composite material and forming a component within a combustion turbine;

the second body fabricated from a 2-dimensional ceramic matrix composite material forming a bolt flange, the bolt flange comprising a first leg connected with the first body and a bolting surface extending from the first leg; and at least one aperture formed within the bolting surface in a direction substantially normal to the second in-plane direction.

7. The composite structure of claim 6 further comprising a thermal barrier coating deposited on a surface of the first body.

8. An assembly for installation in a gas turbine engine, the assembly comprising:

a component fabricated from a ceramic matrix composite material forming a first fiber direction; and a bolt flange fabricated from a ceramic matrix composite material forming a second fiber direction, the bolt flange comprising: a leg affixed to the component: a bolting surface extending from the leg wherein the first fiber direction is substantially normal to the second fiber direction; and at least one aperture formed in the bolting surface substantially normal to the second fiber direction.

9. The assembly of claim 8 further comprising at least one aperture formed through the bolting surface and substantially normal to the second fiber direction.

10. The assembly of claim 9 further comprising an upper surface of the leg of the bolt flange positioned beneath an exterior surface of the component.

11. The assembly of claim 8 further comprising a recess formed within the component wherein the leg of the bolt flange is affixed within the recess.

12. The assembly of claim 11 further comprising a filament wound onto the component and over the leg.

13. The assembly of claim 11 further comprising:

a slot formed within the bolt flange; and a key fitted within the slot and affixed to the component.

* * * * *